US011352239B1

(12) United States Patent
Spitsbergen

(10) Patent No.: US 11,352,239 B1
(45) Date of Patent: Jun. 7, 2022

(54) PORTABLE HOIST SYSTEM WITH ADJUSTMENT FEATURES

(71) Applicant: Michael Spitsbergen, La Mesa, CA (US)

(72) Inventor: Michael Spitsbergen, La Mesa, CA (US)

( * ) Notice: Subject to any disclaimer, the term of this patent is extended or adjusted under 35 U.S.C. 154(b) by 0 days.

(21) Appl. No.: 16/784,199

(22) Filed: Feb. 6, 2020

Related U.S. Application Data

(63) Continuation of application No. 15/498,306, filed on Apr. 26, 2017, now abandoned.

(51) Int. Cl.
*B66C 23/16* (2006.01)
*B66C 23/48* (2006.01)
*B66C 23/44* (2006.01)

(52) U.S. Cl.
CPC ..... *B66C 23/166* (2013.01); *B66C 23/44* (2013.01); *B66C 23/48* (2013.01)

(58) Field of Classification Search
CPC ..... B66C 23/00; B66C 23/06; B66C 23/16; B66C 23/163; B66C 23/26; B66C 23/36; B66C 23/365; B66C 23/42; B66C 23/46; B66C 23/48; B66C 23/60; B66C 23/68
USPC ..... 212/179, 180, 181
See application file for complete search history.

(56) References Cited

U.S. PATENT DOCUMENTS 1,247,706 A 11/1917 Moran
1,377,063 A 5/1921 Gaj
2,305,202 A 12/1942 Smith
2,487,305 A 11/1949 Bridegroom
2,496,401 A 2/1950 McKinney
2,592,993 A 4/1952 Adams
2,670,086 A 2/1954 Eisberg
2,717,751 A 9/1955 Kusiv
2,888,111 A 5/1959 Evans
3,048,371 A 8/1962 Klimek
3,060,614 A 10/1962 Prince
3,121,556 A 2/1964 Faulkner
3,638,806 A 2/1972 Hippach
3,802,653 A 4/1974 Nyulassie
3,845,869 A 11/1974 Sowers et al.
3,879,907 A 4/1975 Olson
4,030,733 A 6/1977 Merrihew et al.
4,082,161 A 4/1978 Johnson
4,171,116 A 10/1979 Carver
4,600,348 A 7/1986 Pettit
4,671,731 A 6/1987 Harlan
4,709,783 A 12/1987 Tomioka et al.
4,714,226 A 12/1987 Tracy
4,833,566 A 5/1989 Nickola
4,880,346 A 11/1989 Brassette
5,064,078 A 11/1991 Van Staveren
5,211,297 A 5/1993 Vandervalk
5,211,526 A 5/1993 Robinette
(Continued)

*Primary Examiner* — Michael R Mansen
*Assistant Examiner* — Juan J Campos, Jr.
(74) *Attorney, Agent, or Firm* — Thomas M. Freiburger

(57) ABSTRACT

A portable hoist system has an adjustable support strut mechanism, allowing for compact storage and portability, with the entire assembly retained as one unit. In one embodiment the support strut mechanism, which is connected on one end to a boom and at another end to a bracket, is foldable and adjustable using an adjustment pin and holes along the two-piece support strut mechanism. In one preferred form of the invention a winch of the hoist system is field-adjustable as to position on the hoist's boom, to overcome problems of space constraints.

18 Claims, 11 Drawing Sheets

(56) References Cited

U.S. PATENT DOCUMENTS

| | | | |
|---|---|---|---|
| 5,316,265 | A | 5/1994 | Welch et al. |
| 5,341,898 | A | 8/1994 | Baziuk |
| 5,431,526 | A | 7/1995 | Peterson et al. |
| 5,445,281 | A | 8/1995 | Hung |
| 5,445,487 | A | 8/1995 | Koscinski, Jr. |
| 5,456,433 | A | 10/1995 | Bums et al. |
| 5,459,891 | A | 10/1995 | Reeve et al. |
| 5,564,453 | A | 10/1996 | Steiner |
| 5,584,363 | A | 12/1996 | Curtin et al. |
| 5,605,305 | A | 2/1997 | Picton |
| 5,622,237 | A | 4/1997 | Moldow |
| 5,662,451 | A | 9/1997 | Muzzi et al. |
| 5,667,352 | A | 9/1997 | Curtin et al. |
| 5,725,112 | A | 3/1998 | Thorby |
| 5,752,799 | A | 5/1998 | Carey et al. |
| 5,788,095 | A | 8/1998 | Watson |
| 5,800,117 | A | 9/1998 | Milton |
| 5,816,554 | A | 10/1998 | McCracken |
| 5,897,101 | A | 4/1999 | Snyder |
| 6,038,829 | A | 3/2000 | Franks |
| 6,065,621 | A | 5/2000 | Fatemi et al. |
| 6,135,300 | A | 10/2000 | Fox |
| 6,138,991 | A | 10/2000 | Myers |
| 6,152,675 | A | 11/2000 | Compton |
| 6,276,665 | B1 | 8/2001 | Hawkins et al. |
| 6,478,172 | B2 | 11/2002 | Zingerman |
| 6,499,610 | B2 | 12/2002 | Spitsbergen |
| 6,821,075 | B2 | 11/2004 | van der Horn |
| 6,926,120 | B1 | 8/2005 | Bradley |
| 6,983,157 | B2 | 1/2006 | Yamagishi et al. |
| 7,044,313 | B2 | 5/2006 | Haliburda, III |
| 7,407,039 | B2 | 8/2008 | Bailey |
| 7,419,347 | B1 | 9/2008 | Cormier |
| 7,537,088 | B2 | 5/2009 | Spitsbergen |
| 2001/0010369 | A1 | 8/2001 | Dobmeier |
| 2004/0040925 | A1 | 3/2004 | Miller |
| 2004/0256607 | A1 | 12/2004 | Spitsbergen |
| 2005/0236352 | A1 | 10/2005 | Tien |
| 2008/0063497 | A1 | 3/2008 | Spitsbergen |
| 2008/0197095 | A1 | 8/2008 | Spitsbergen |
| 2008/0217277 | A1 | 9/2008 | Spitsbergen |
| 2009/0173707 | A1 | 7/2009 | Spitsbergen |
| 2009/0173709 | A1 | 7/2009 | Spitsbergen |
| 2016/0115001 | A1 | 4/2016 | Italiano |

PORTABLE HOIST SYSTEM WITH ADJUSTMENT FEATURES

This application is a continuation of application Ser. No. 15/498,306, filed Apr. 26, 2017, now abandoned.

BACKGROUND OF THE INVENTION

The present invention is concerned with a portable hoist or crane system, and in particular relates to an adjustable, telescoping support strut mechanism and an adjustable slide mechanism for a lift mechanism in such portable hoist or crane systems.

An example of a portable hoist system is shown in U.S. Pat. No. 6,499,610, commonly owned with this invention and fully incorporated herein by reference. The portable hoist system is shown with a boom arm, a support strut mechanism, and a body or base, the support strut mechanism having a release mechanism to allow a user to fold the assembly for portability. Further portable hoist apparatus is shown in U.S. Pat. No. 7,537,088, also owned by the current applicant and incorporated herein by reference.

The portable hoist system of U.S. Pat. No. 6,499,610 allows for portability, but not adjustability of the support strut mechanism to allow different heights for the boom arm and to allow a user to adjust the angle of the boom arm for space constraints without removing the strut. Additionally, the safety features could be improved, as well as the ease of portability and foldability of the system. Further, in areas of space constraints it is often necessary to have the lift mechanism repositioned along the boom arm, which requires re-fitting of the lift mechanism by the manufacturer. Accordingly, there remains a need in the art for a safer, more easily adjustable and more easily foldable portable hoist system with a slide mechanism for adjusting the position of the lift mechanism.

The '610 patent discloses a mechanical arrangement for folding a strut or brace from a center pivot and storing it within the channel of the boom. Also, that patent describes adjustment among three different positions of inclination of the boom, via different positions of connection of the brace to the boom.

It is an object of this invention to overcome problems of space constraints and height requirements of the boom arm, while also providing a safer, simpler and more easily used arrangement of a foldable assembly that is portable and compactly stowable. Another object, in a specific embodiment of the invention, is to facilitate release of the support strut mechanism and portability of the entire assembly by a single person, while retaining the system as one unit.

Further, there remains a need in the art for a safer portable hoist system, one that is an easily adjustable and foldable portable hoist system. With the addition of an adjustable boom support strut mechanism and an adjustable slide mechanism for a lift mechanism, the problems of space constraints and the need for easy and safe adjustability of the angle of the boom are overcome, as explained below.

SUMMARY OF THE INVENTION

An adjustable support strut mechanism for a portable hoist system, generally of the type described in U.S. Pat. No. 6,499,610, solves problems of confined space where there are space constraints and allows for easy and safe adjustment of the inclination and height of the boom. In addition, the invention in one preferred embodiment allows a single user to manipulate the assembly and carry it easily to different locations.

In one embodiment, an adjustable support strut mechanism for a portable hoist assembly comprises a telescoping structural brace with inner and outer relatively slidable arms. Holes along the support strut mechanism allow a user to adjust the length of the support strut mechanism using an adjustment pin, to adjust the height of the boom. The slidable arms allow the entire assembly to fold for portability while retaining the pieces of the assembly as one unit, which makes it a safer assembly.

In a preferred embodiment, the boom and support strut mechanism can be locked in the folded position by inserting the adjustment pin in a different position.

In another preferred embodiment, the load to weight ratio of the portable hoist system is at least 35, or greater than 35.

The portable hoist system of the present invention in one preferred embodiment is a light-weight, easily and safely set up, inexpensive system which may be easily moved in a compacted size from place to place, with the benefits of an adjustable boom support strut mechanism and an adjustable winch positioning mechanism, thus providing the ability to move loads to or from the roof of a building, to or from the cargo space of a vehicle, a trailer, or any other type of transport system, or in any confined space, and safely adjust the portable hoist system to the level or levels needed for use and adjust the position of the lift mechanism to overcome problems of confined space while retaining the pieces of the system as one unit.

In a preferred embodiment, the position of connection of the support strut mechanism to the body is less than six inches below the boom's pivotal securement to the body, and preferably about four inches, even with a boom length of three to four feet.

Accordingly, a principal object of the invention is to provide a simple and safe and easily adjustable and foldable portable hoist system. These and other objects, advantages and features of the invention will be apparent from the following description of preferred embodiments, considered along with the accompanying drawings.

DESCRIPTION OF PREFERRED EMBODIMENTS

Figure 1:
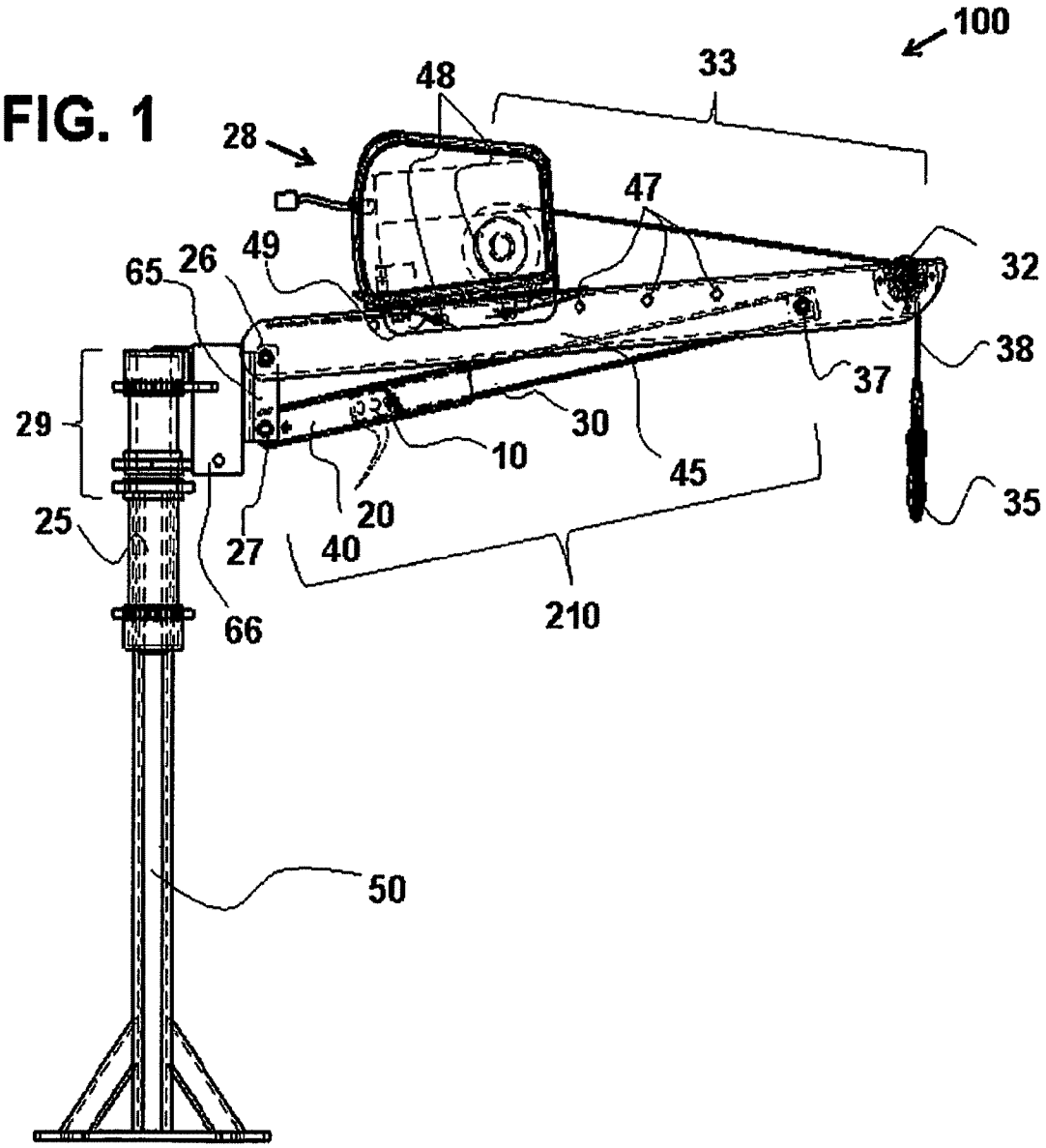
FIG. 1 is a side elevation view of a first embodiment of the hoist assembly, including a telescoping support strut mechanism and an adjustable slide mechanism of the invention, mounted to a body or frame and including a powered lift mechanism or winch along the boom.
Figure 2:
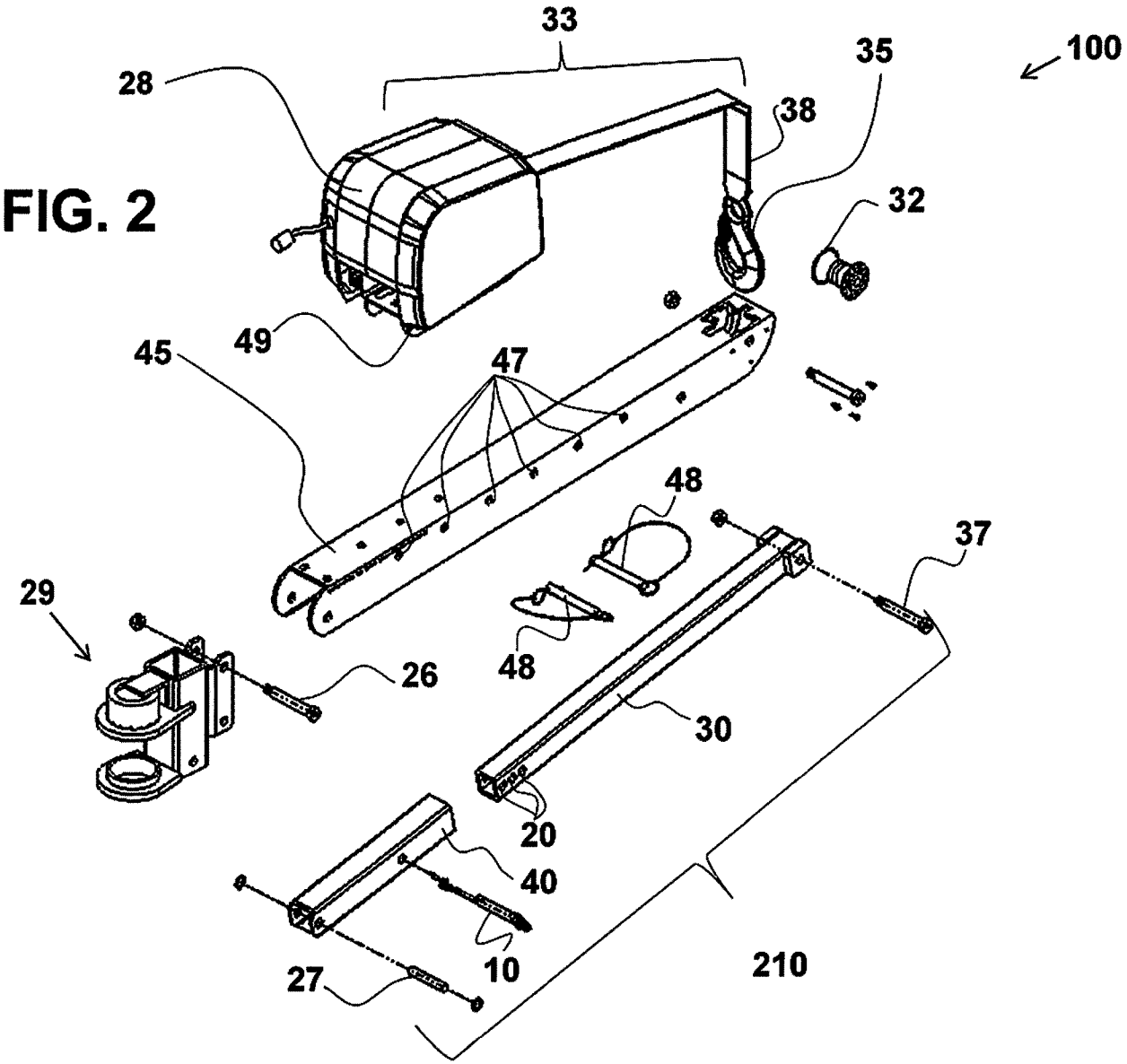
FIG. 2 is an exploded perspective view of the portable hoist system of FIG. 1.
Figure 4:
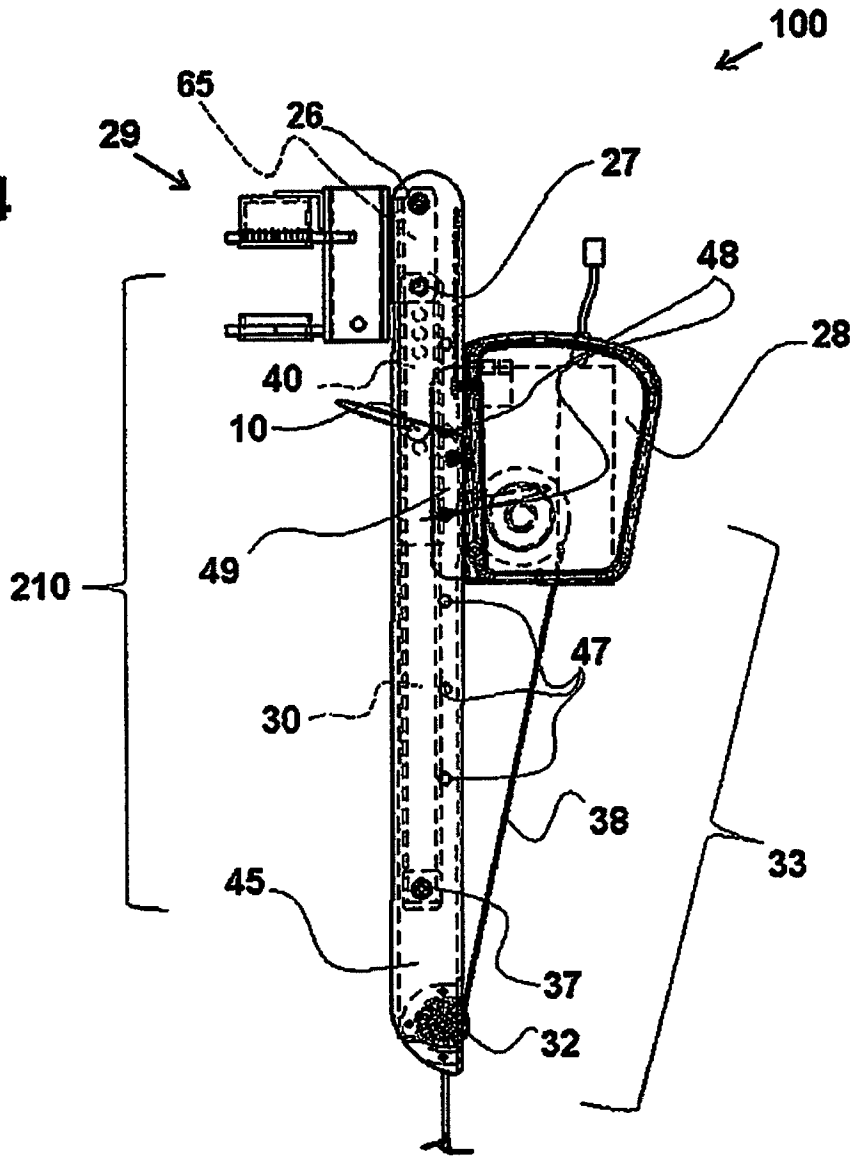
FIG. 4 is a side elevation view of the hoist system of FIG. 1, with the boom folded down with respect to its mounting.

As shown in FIG. 1 and FIG. 2, key features of the portable hoist system 100 of the present invention are an adjustable support strut mechanism 210 for a boom 45, and an adjustable slide positioning mechanism 49 for a winch or motorized lift mechanism 28. In a first embodiment of the adjustable, preferably telescoping support strut or brace mechanism 210 shown in FIG. 1, an adjustment pin 10 is placed in one of a series of holes 20 along the support strut mechanism 210. An outer arm 40 of the telescoping support strut mechanism 210 houses an inner arm 30 which can telescope in and out for length adjustability and foldability of the strut or brace 210. One of the arms has a series of spaced holes and the other has at least one hole, so that the holes can be aligned at the desired length position and the pin 10 can be inserted. With the pin removed the boom 45 can be folded fully down to vertical about the boom pivot axis 26, and the pin re-inserted (FIG. 4, discussed below). A pivot connection 27 secures an inner or proximal end of the strut 210 to a body bracket 65 to which the boom is also connected. The outer (distal) end of the strut 210 (i.e. of the arm 30) is secured to the boom at a remote pivot connection 37 on the boom. As shown in FIG. 1 and other drawings, the boom 45, strut 210 and body bracket 65 between pins 26 and 27 form a geometric shape of a triangle with a sharply acute angle, shown in FIGS. 1 and 9 as about 8° or less with the boom essentially horizontal as shown.

As shown in FIGS. 1 and 2, the adjustable support strut or brace 210 preferably is truly telescoping, with the arms 40 and 30 being box beams, one sliding within the other. Alternatively, these arms could simply be other linear structural members side by side and overlapping, preferably with some guide structure for sliding, and with one or two pins (or other connectors) to hold a length position.

The boom 45 and adjustable strut 210 are connected at pivot points 26, 27 that are relatively close together, which gives the advantage of clearance below, needed for many objects being lifted and also for nearby structures in some situations. These pivot axes can be, for example about four inches apart, or more broadly, less than five inches, or less than six inches, in each case for a boom having a length of about three to four feet, or somewhat greater. Such a hoist can have a load capacity of up to approximately 1000 pounds. The hoist can be larger, even much larger if weight and size are not limiting considerations; the general proportions set forth above can be scaled larger.

Figure 3:
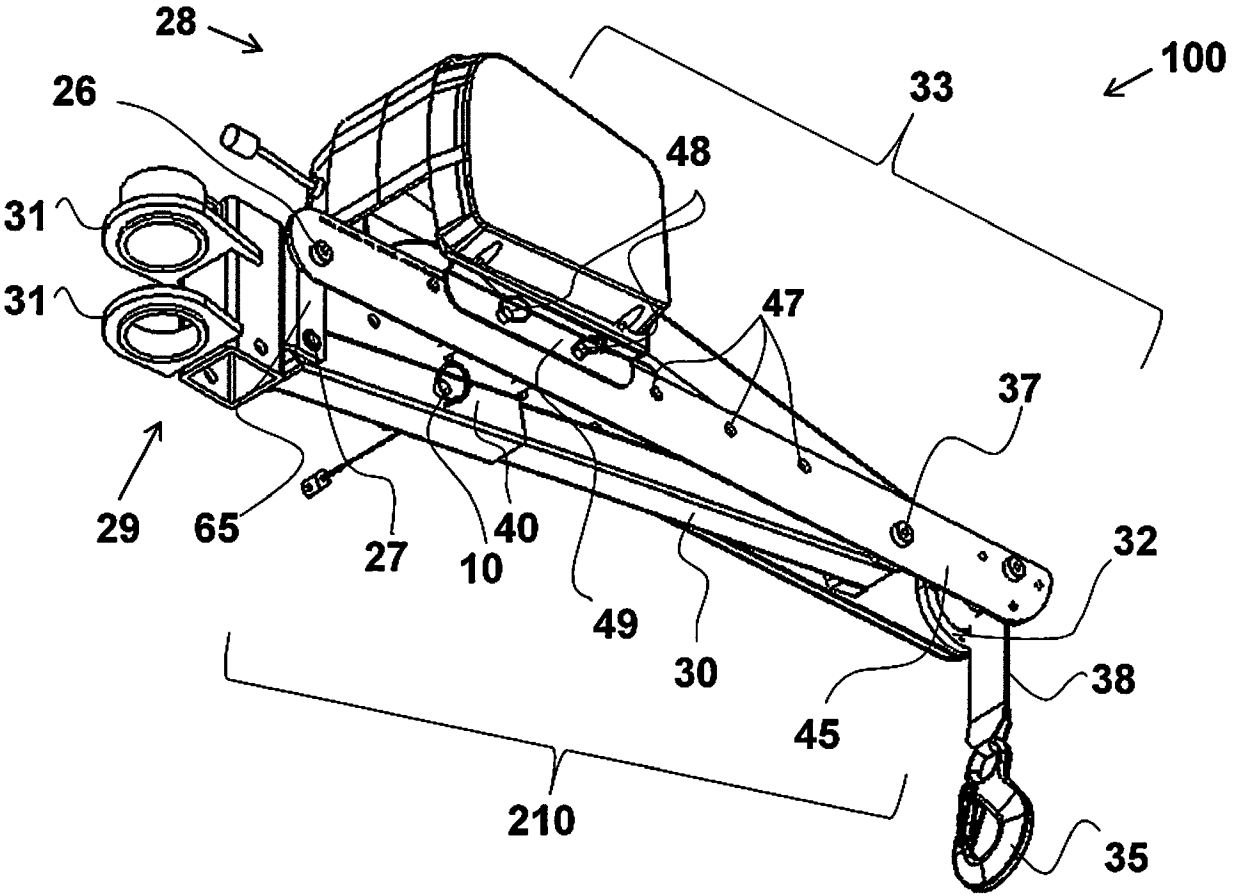
FIG. 3 is a bottom perspective view of the hoist assembly of FIG. 1.

The pivot points 26, 27 are on the bracket 65 which is part of what can be referred to as a frame or body 29 of the hoist assembly. The body 29 includes any other structure that provides for mounting on a stable object or body and that remains with the portable hoist, i.e. with the boom 45 and adjustable strut 210. Note that the "body" as referenced in the claims could include more than what is shown at 29, including any structure that is affixed to the body bracket 65 and which can provide for preferably quick connection to a stable structure to support the hoist, although the portable winch assembly in a preferred form is limited in components to what is shown in FIGS. 2 and 3.

A rope or webbing control assembly 33 is located on the boom 45. The rope or webbing control assembly 33 includes a cable, web strap or synthetic rope 38 which runs from the winch or windlass drum 28, mounted on the boom 45, over a guide bar or rotating pulley 32.

FIG. 2 shows the portable hoist assembly 100 and a preferred embodiment of the telescoping support strut 210 comprised of the inner arm 30 and the outer arm 40, in exploded view. The adjustment pin 10 can be inserted through selectively aligned holes 20 along the support strut 210. A pivot pin 27 connects the support strut mechanism to the body 29, in this particular preferred embodiment to the bracket 65 of the body. The boom 45 connects to the body via a pivot pin 26. The outer end of the support strut 210 is secured by a pivot pin 37 to the boom arm 45. The winch or windlass drum 28 is mounted along the boom arm 45 with the rope or webbing assembly 33 including a rope or webbing 38 running from the drum 28 and around the pulley wheel 32 and including a hook or other end component or attachment 35 at the end of the rope or webbing 38.

A feature of the invention is adjustable positioning of the winch 28 on the boom. Holes 47 along the boom 45 allow for insertion of pins 48 into the holes 47 through a bottom saddle of the winch assembly, to position the lift mechanism at various places along the boom to overcome problems of space constraints. Although the winch is preferably on the boom, it could be mounted elsewhere, such as on the mast structure 50 or the pivot tube 25, with provision for position adjustment when needed, or even on a part of the strut 210. The tension line 38 would then be placed over the boom end pulley 32 after placement of the hoist (with an opening in the boom for the tension line, with the pulley suspended below the boom end).

FIG. 3 is a bottom perspective view of the portable hoist system 100 of FIGS. 1 and 2, without any supporting structure or fixed object to which the hoist would be attached. The adjustment pin 10 is indicated as being inserted into aligned holes 20 of the two arms in the adjustable strut 210. The winch or windlass 28 is shown attached by the pins 48 to the boom at a selected position. This quick-release winch adjustment and removal feature can be achieved with other structures, if desired. For example, horizontal dowels or pins fixed on the bottom of the winch 28 could be engaged into angled slots provided on the boom or on a bracket fixed to the top of the boom, or the winch could have hooks fixed at bottom, to engage in the holes in the boom. As noted above, the winch 28, in another embodiment (not shown) could be mounted elsewhere, such as on the mast 50 or tube 25, and it could be adjustable as to position along the length of either.

For securing the hoist 100 to a fixed or stable structure (e.g., a truck, building, etc.) the body in this preferred embodiment includes two spaced apart cylindrical mounting collars 31, rigidly fixed to the structural bracket 65 and with internal sleeves or grommets for rotatable mounting on a cylindrical part of the apparatus for mounting the hoist, such as the pivot mast 25 seen in FIG. 1 as part of the mounting structure, which in this example includes a base mount 50. This allows hoist rotation with relatively low friction.

Figure 1A:
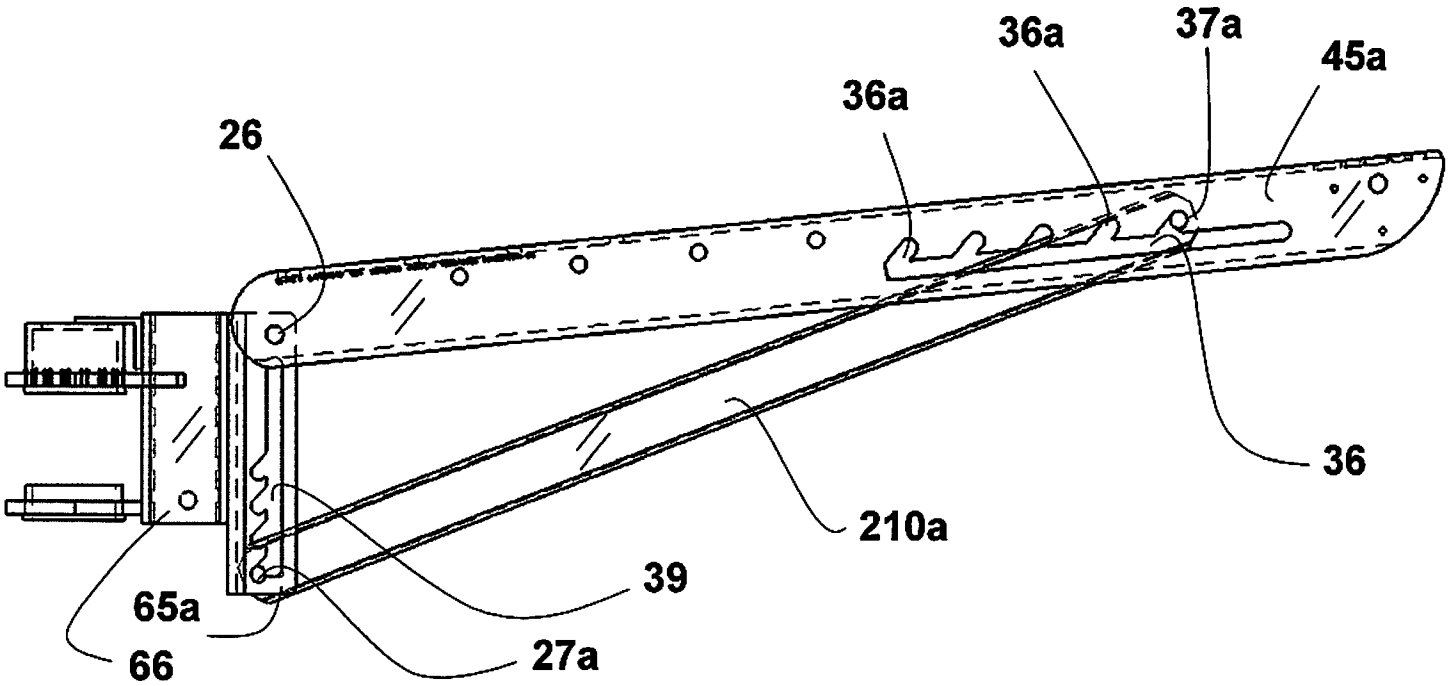
FIG. 1A is a schematic side elevation view showing an alternative for some of the structure of FIG. 1.

FIG. 1A shows alternative structure for an adjustable strut or brace 210*a* of the portable hoist assembly, for quickly and easily adjusting the inclination of the boom, shown here as

45*a*, thus adjusting the height of the boom's remote end. The winch and parts of the body at left are not shown. In this configuration the adjustable brace or strut 210*a* is a single piece, and adjustment of the boom inclination is effected by moving the position of the strut's outer end to different positions along the length of the boom, with these components remaining assembled. The strut 210*a*, which preferably is positioned inside a channel member (as above) forming the boom 45*a*, has a fixed cross bar or cross pin 37*a* near its distal end. This cross pin or cross bar is positioned in a slot 36 of the channel, duplicated on both sides of the channel, and, as illustrated in FIG. 1A, the cross pin can be engaged in any of a series of notches 36*a* for adjustment of the boom's inclination and to hold the boom at the desired inclination. The notches 36*a* preferably are biased in their configuration, angled toward the distal end of the boom, to help assure retention of the cross pin in the selected notch. When the boom is to be folded down for storage, the operator simply lifts the end of the boom slightly, allowing the distal end of the brace 210*a* to drop, and folds the boom down, about a pivot point 27*a*, causing the cross pin 37*a* to move in the distal direction in the boom's slot.

FIG. 1A also shows an optional adjustment slot 39 in the bracket 65*a* to which the boom and the strut are attached. This can provide adjustment at the other end of the strut, via a cross pin 27*a* on the strut, primarily for a different type of adjustment. Moving the position of the cross pin 27*a* up or down, with the connection point 27*a* close to the boom pin 26 (e.g. within six inches for a three to four foot boom), will have only small effects on the boom height. (Note that FIG. 1A is not necessarily to scale.) What the adjustment at the bracket 65*a* can do is to spread the distance between points 26 and 27*a* when needed for more bracing stability, for heavy loads. Also, the strut's proximal end can be lifted in the slot 39, helping facilitate folding down of the beam, with the distal cross pin 37*a* also sliding in the slot 36. Thus, the illustrated strut arrangement can have an adjustment slot 36 in the boom but with a simple pivot pin in the bracket 65*a*, or such slots at both positions. In one preferred embodiment the proximal end of the strut or brace 210*a* simply has a pivot pin connection at 27*a* to the bracket. In any event, the brace or structure shown in FIG. 1A provides for the strut to remain with the boom and bracket of the hoist through all positions of adjustment or storage, with no need for disassembly (if the cross pin 27*a* is included it must be short enough to allow the boom channel to close over the bracket).

FIG. 4 is a side view of the hoist 100, showing the hoist in a folded position with the telescoping support strut mechanism 210 housed within the boom arm 45, which preferably is an open-bottomed channel, essentially vertical in this stored position. The pin 10 is inserted into a different position to hold the boom in folded down position. This can be through aligned holes (not shown) in the boom and strut between the pivot axes 26 and 27; or it could involve the arm 40 hole but engaged through a hole in the boom 45 (not seen in FIG. 4) to lock the stowed position. It is a significant feature of the invention that the adjustable strut remains connected at both ends to the boom and to the body when stored, with the strut contained within the channel of the boom. The outer end pivot connection 37 of the strut is within the channel and all elements of the strut fit into the channel, as shown. Field assembly/disassembly of the hoist is avoided (other than inserting/removing pins and placing the body 29 on a mount structure).

Figure 5:
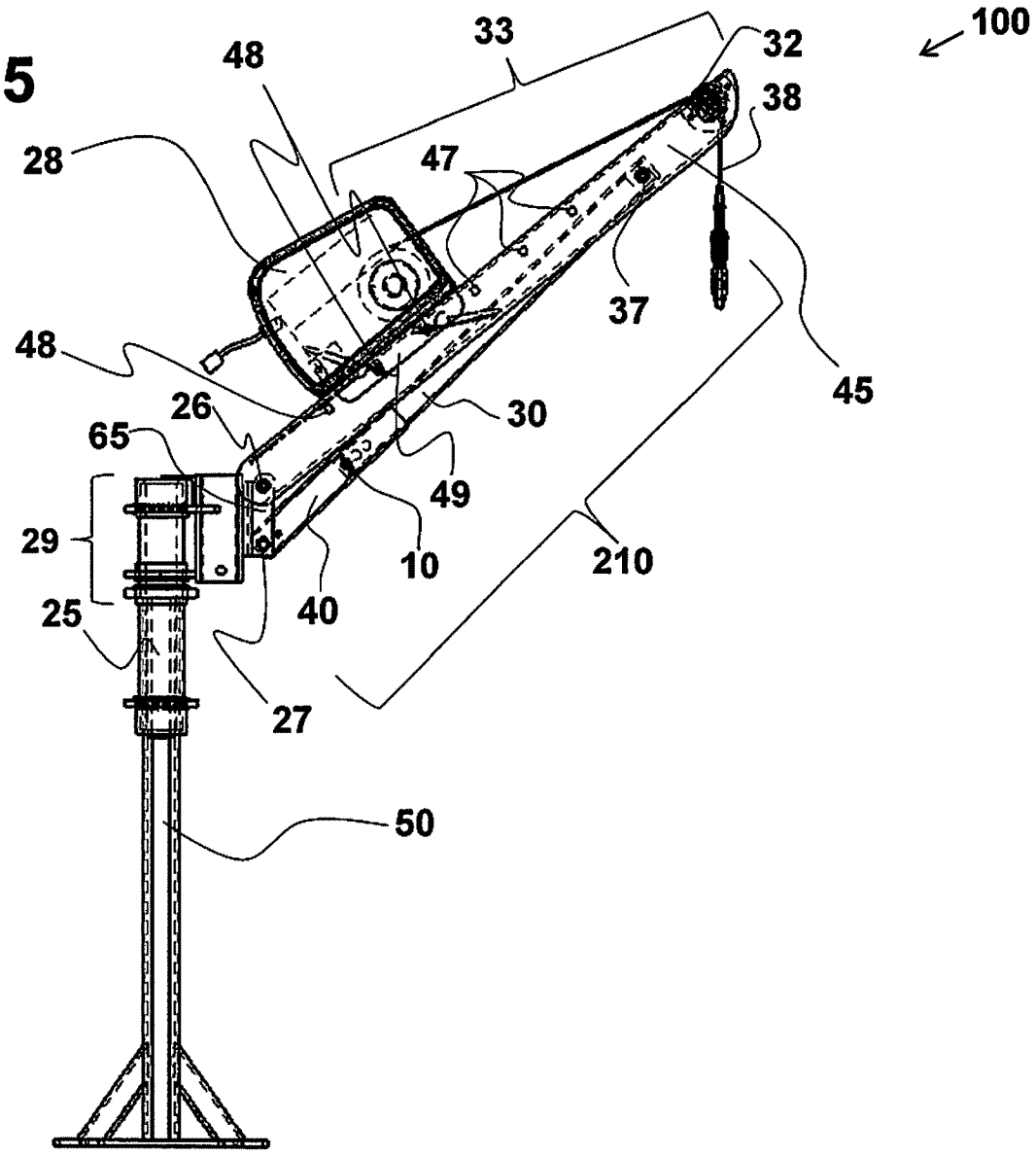
FIG. 5 is a side elevation view of the hoist assembly of FIG. 1, showing the boom arm angled to a higher inclination.

FIG. 5 is a side view of the portable hoist, shown in a position with the telescoping support strut mechanism 210 extended to lift the boom 45 to a high inclination.

Figure 6B:
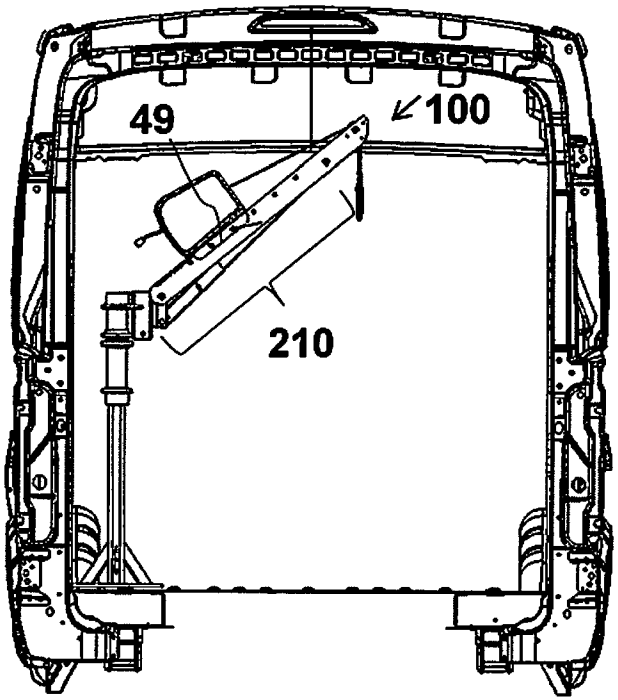
FIGS. 6A and 6B are side elevation views of the hoist assembly of FIG. 1, showing the assembly in a confined space such as the inside of a van, and with the assembly folded down for storage and erected up for lifting, respectively.
Figure 6A:
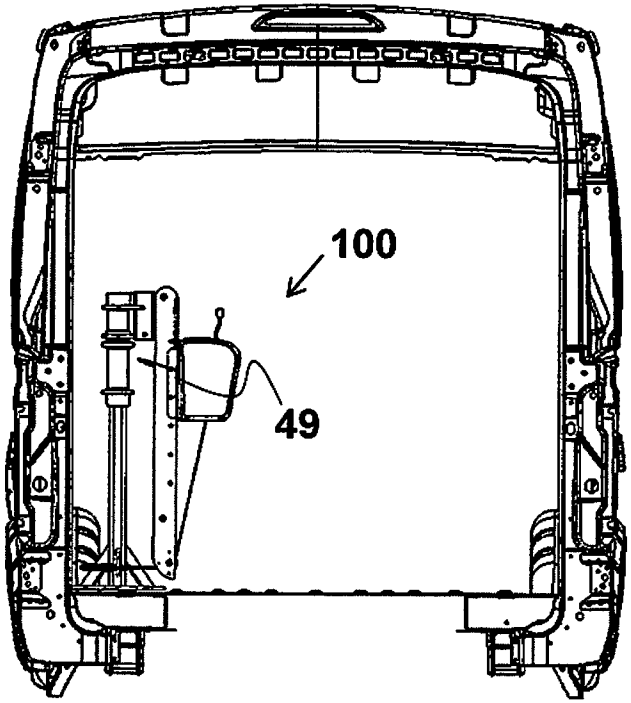

FIGS. 6A and 6B illustrate use of the portable hoist assembly 100 in a vehicle such as a van. The mounting apparatus 25, 50 support the hoist 100, with the structural component 50 fixed securedly to the van's floor and preferably to vehicle frame structure below the floor. FIG. 6A shows the assembly folded down for storage in a confined space inside the van, while FIG. 6B shows the assembly erected up for lifting in the confined space of the van.

Figure 7:
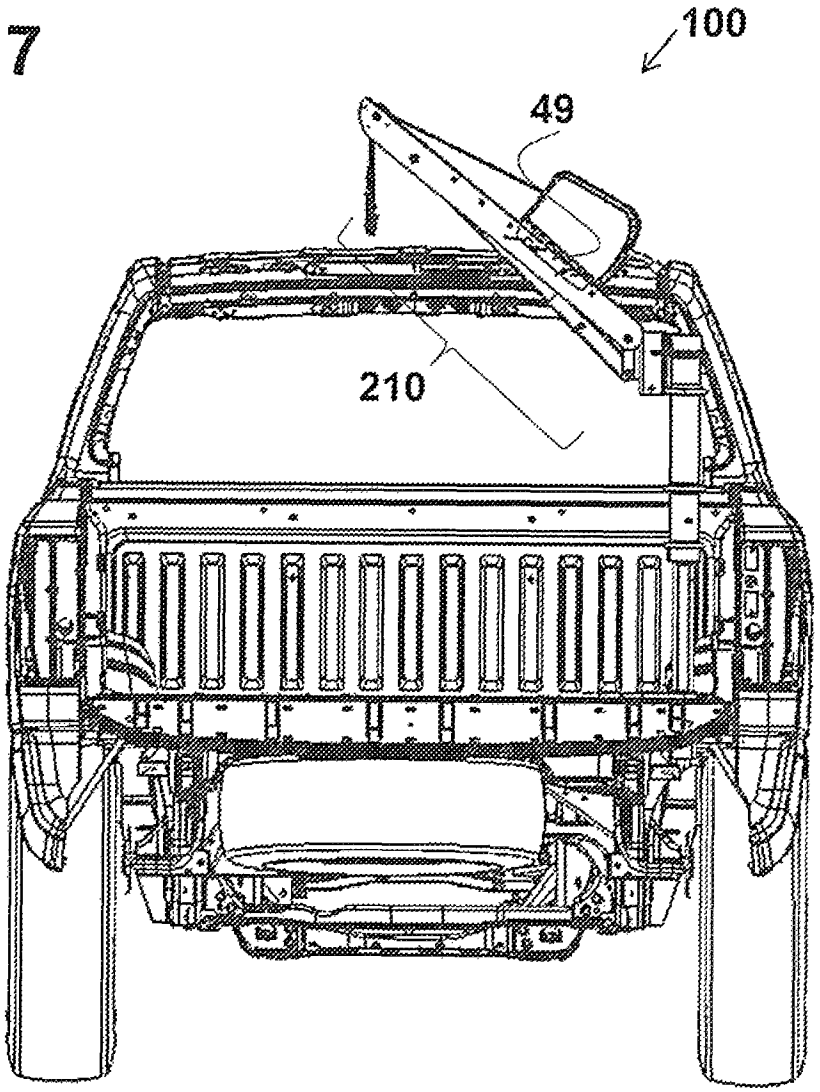
FIG. 7 shows the rear of a vehicle, such as a pickup truck, and illustrates the hoist assembly mounted for use on the vehicle.

FIG. 7 is a rear view of a pickup truck, partially in perspective, showing the hoist assembly 100 set up for working from the truckbed.

Figure 8:
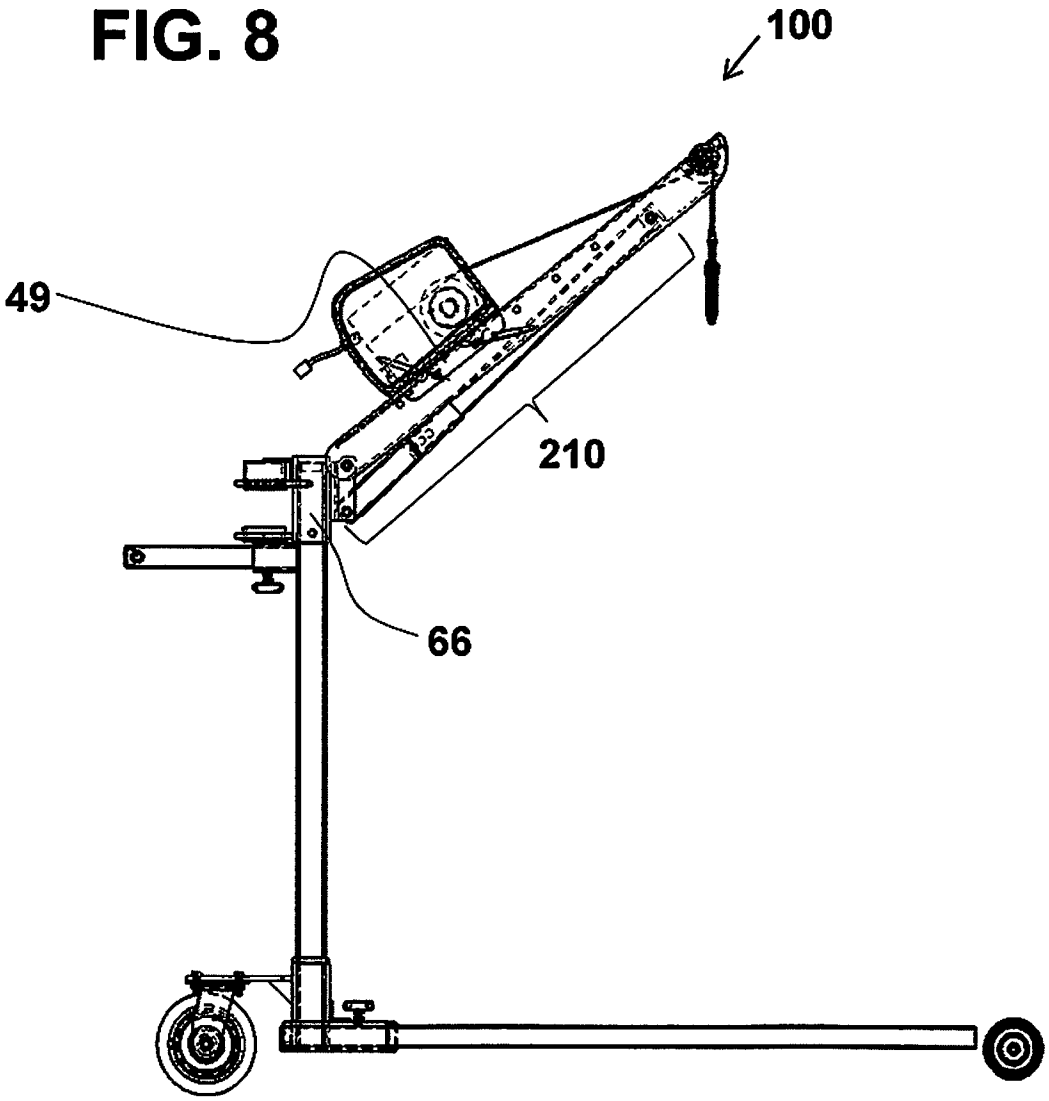
FIG. 8 is a side elevation view showing another application of the hoist assembly of the invention, attached to a rolling cart.

FIG. 8 is a side elevation view showing the hoist assembly 100 attached to a support apparatus 120 which is secured to a rolling cart. In this example a tubular structural member 66 of the body receives the support apparatus 120, without using the cylindrical collars 31.

Figure 9:
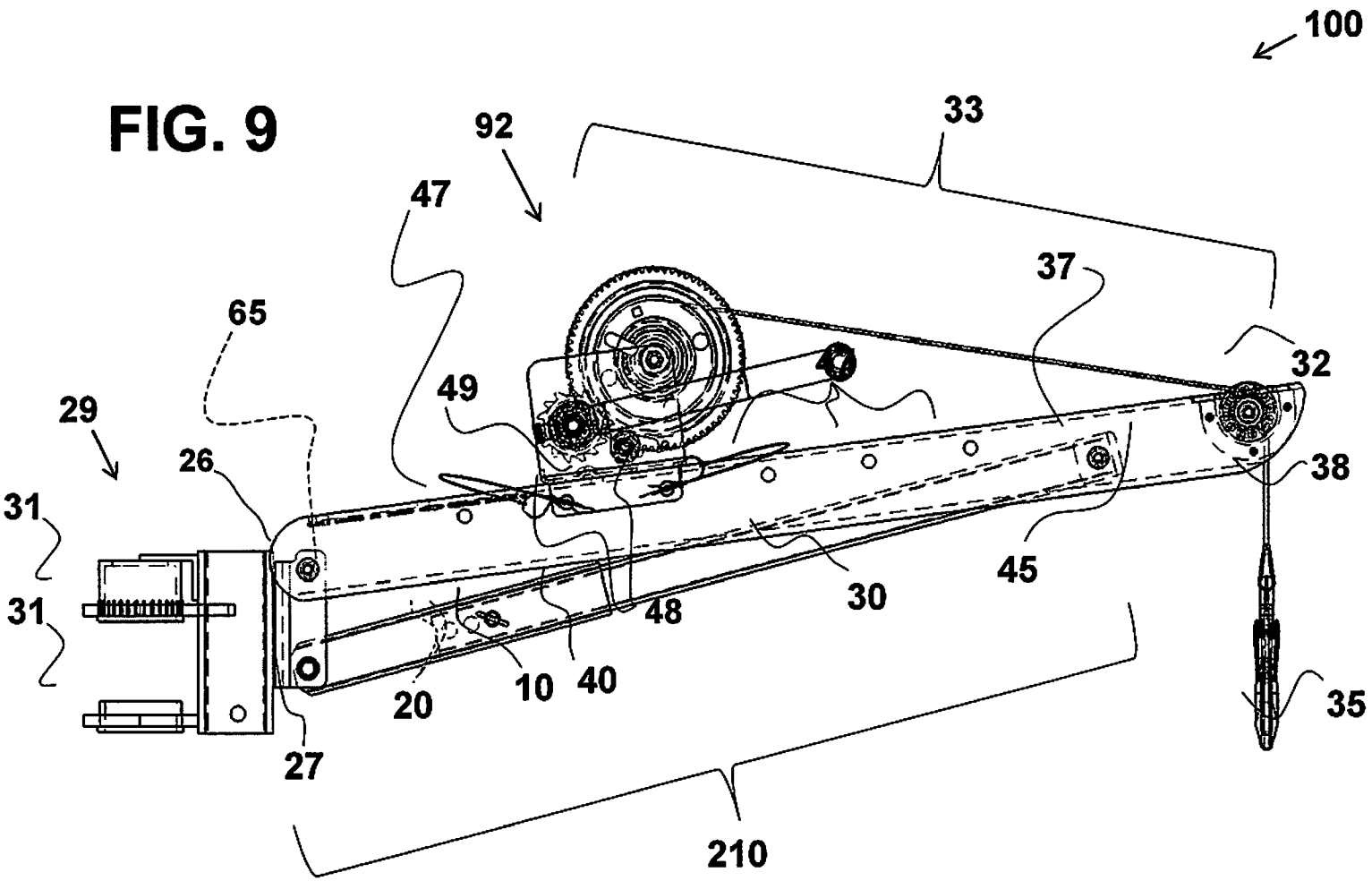
FIG. 9 is a side elevation view showing another embodiment of the hoist assembly, with a manual winch along the boom, rather than a motor-driven winch.

FIG. 9 is a side elevation view of a second embodiment of the hoist assembly 100. In this case lifting is effected using a manual winch 92 secured at a selected position along the boom 45. The control assembly 33 connects to the manual winch 92 and includes a cable, strap or synthetic rope 38 mounted on the boom 45 over a guide bar or rotating spool 32.

Figure 10:
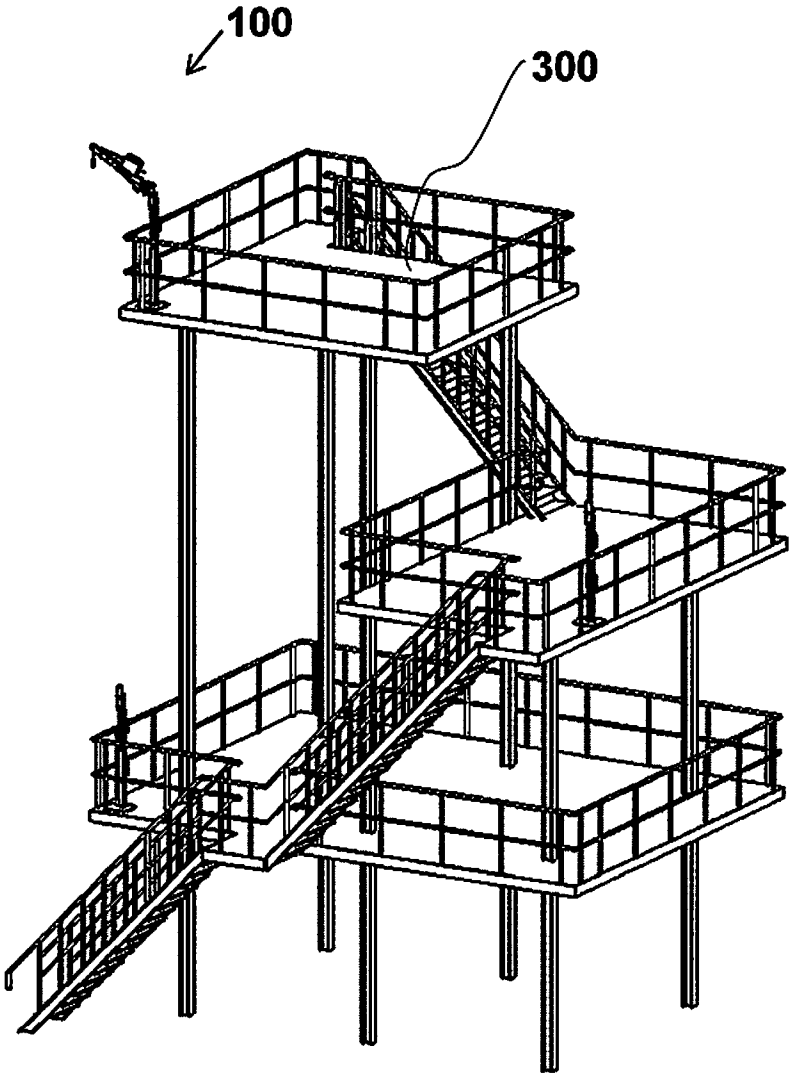
FIG. 10 is a perspective view illustrating another application of the invention, on a platform.

FIG. 10 is a perspective view showing an elevated platform 300 on which the hoist assembly 100 can be mounted and used.

As will be understood by those of ordinary skill in the art, the portable hoist system 100 can easily be mounted upon any platform such as the deck of a dock, the bed of a trailer, a watercraft, or even in a large aircraft, on a pole, a building, a bridge, a platform, a tower, or any other stable structure. The portable hoist system 100 can also be folded and retained as one compact unit for portability or stowing, without the need for dissasembly. Further, the body 29 need not be configured to engage with a vertical mount; it could be configured to be connected to a non-vertical structural element of a building, vehicle, elevator shaft, tower, platform, or other structures such as in the military, solar power or oil industries, etc.

When the lifting job is completed, the portable hoist system 100 can be removed from a supporting mount or base 50 and folded up and retained as one unit into a neat bundle and carried down a ladder or a stairway to the next location. It has been found that a portable hoist system 100 made of structural aluminum and steel weighs about 30 to 40 pounds and can have a maximum lifting capacity of nearly 1000 pounds. Aluminum is chosen for major components of the preferred embodiment because it remains cool to the touch even in hot weather, it resists corrosion, and is inexpensive and light in weight. The adjustable strut mechanism can be steel. Other metals such as titanium or composites or other materials may also be used, preferably keeping the weight of the hoist down so as not to exceed a weight easily transportable by an individual.

More specifically, the boom arm may be constructed of light-weight material so as not to exceed 50 pounds total weight of the assembly in a preferred embodiment. The portable hoist 100 preferably has a load capacity to hoist weight ratio (load to weight ratio) of 15 to 40, or 20 to 40, more preferably 30 to 40, and most preferably 30 or above 35.

Many variations of the present invention are available. For example, the telescoping support strut mechanism 210 could be mounted on top of the boom 45 (not shown), to act in tension. Another embodiment could include the outer arm 30 and the inner arm 40 of the telescoping support strut mechanism 210 in a reversed configuration (not shown), where the outer arm is connected to the boom 45 and the inner arm is connected to the bracket. Still other length-adjustment arrangements are possible, without using two box beams, as discussed above.

While an open hook 35 is shown on the end of the strap 38, those of ordinary skill will understand that a variety of different lifting devices may be attached at the end of the strap 38 to include closed hooks, plate grippers, lifting bars, a ring, or a clevis.

Those of ordinary skill in the art will also realize that two or more hoists may be used with one vehicle to lift particularly heavy loads, off-balance loads, or exceptionally large equipment.

Once installed, in a preferred embodiment the portable hoist system 100 of the present invention may be used to lift a variety of different loads heretofore not movable by a single person. Such loads may include, but are not limited to: palletized loads, small yard machines, tree stumps, automobile engines, farm equipment, large truck tires, furniture, small off-road vehicles, deer, generators, large poles, small watercraft, rocks, small motorcycles, fuel/oil drums, appliances, and articles in the military, oil, power, utility, solar/wind/alternative energy and railroad industries, as well as other industries.

Once a lifted item has been placed in or on a building, platform, tower or similar, or in the bed of a pickup truck, in a van, in a car, or into the cargo space of any type of vehicle in which it used, the portable hoist assembly 100 of the present invention is simply lifted from its mounting and configured for storage and retained as a single unit. Specifically, the adjustment pin 10 used to set the length of the support strut mechanism to the brace member is removed. As noted above, the boom arm 45 preferably is a channel member open at bottom so that the telescoping support strut mechanism 210 comprised of first and second arms fits into the channel of the boom, and support structures 25, 50 may then be nested together with the boom.

Those of ordinary skill in the art will understand that numerous improvements and modifications may be made to the disclosed portable hoist system without departing from the scope of the invention. Such improvements and modifications may include, but are not limited to: adding a motor drive or power assist to the winch assembly; adding a weight indicator; including a ratchet system in the connection between the substantially vertical arm and the support body; including a bearing connection such as ball bearings in the connection between the tube 25 and the support body; including a light system for night operations; adding a motor drive or power assist to assist in the rotation of the hoist support assembly about the supporting structure; reinforcing the support strut mechanism with a thicker cross section at its distal end.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A portable hoist assembly including an adjustable support strut mechanism, comprising:

a body providing for stable and secure mounting of the portable hoist assembly, the body serving as a support and including vertically separated upper and lower pivot points for connection to a boom and the support strut mechanism;

the body including a cylindrical mounting element configured to slip together with a top end of a cylindrical pivot mast to be lowered into connection with the mast for pivotable support on the mast, and the body being a short body having limited height defined by a height of the cylindrical mounting element and extending to just below the pivot point for connection to the strut;

the boom pivotally secured to the base at said upper pivot point as a horizontal pivot axis at one end of the boom for up and down swinging adjustment of a remote end of the boom relative to the body;

a motorized lift mechanism, with a tension line extending outwardly relative to the boom and suspended from the remote end of the boom;

the boom having a length of at least three to four feet;

said adjustable support strut mechanism comprising a linear structural member having two ends, one end connected to the body at said lower pivot point below the boom, less than six inches below said upper pivot point of connection to the boom, and the other end connected to the boom at a pivot connection remote from the body, to act as a support strut for the boom, the body, the boom and the support strut thus defining a geometric shape of a triangle with a sharply acute angle at said pivot connection when the boom is essentially horizontal;

said adjustable support strut mechanism having adjustment means for adjusting an angle of inclination of the boom and also allowing folding down of the boom for storage while the strut and boom remain connected to the boom and the body, without disassembly, the adjustment means comprising the linear structural member further comprising a first arm connected to and slidable with respect to a second arm so as to adjust the length of the support strut and thus to adjust the angle of inclination of the boom with respect to the body, with a locking structure for securing linear structural member at a selected length to provide a desired boom inclination;

the boom being a structural channel open at bottom, and wherein the first and second arms fit into the channel of the boom when the boom is folded downwardly, with the support strut mechanism remaining connected to the boom and to the body, to form a compact portable and storable configuration defined by the boom, the lift mechanism and the body;

the portable hoist assembly having a total weight less than 45 pounds; and the portable hoist assembly having a load lifting capacity of approximately 1000 pounds.

2. The portable hoist assembly of claim 1, wherein the boom is configured to fold down from said one end of the boom to a substantially vertical orientation.

3. The portable hoist assembly of claim 1, wherein the support strut mechanism comprises telescoping inner and outer arms.

4. The portable hoist assembly of claim 3, wherein each of the inner and outer arms is a box beam.

5. The portable hoist assembly of claim 3, wherein said locking structure comprises a series of spaced holes in one of the first and second arms, a hole in the other of the arms positioned to be aligned with any of the holes in the one arm, and a pin for insertion through aligned holes to lock a selected length of the support strut mechanism.

6. The portable hoist assembly of claim 1, with a load to weight ratio in the range of 20 to 40.

7. The portable hoist assembly of claim 1, wherein the load to weight ratio is greater than 35.

8. The portable hoist assembly of claim 1, wherein said position of connection of the support strut mechanism to the body is no more than about four inches below the boom's pivotal securement to the body.

9. The portable hoist assembly of claim 1, wherein the adjustment means of the support strut mechanism comprises a single-piece strut with means for selecting among different positions of connection of a distal end of the strut to the boom, while the strut remains connected at both ends.

10. The portable hoist assembly of claim 9, further including proximal strut position adjustment means for selecting among different upper or lower positions of connection of the proximal end of the strut to the body.

11. The improvement defined in claim 1, wherein the lift mechanism includes an electric motor.

12. The portable hoist assembly of claim 1, wherein the lift mechanism is secured to an upper side of the boom, positioned to draw in or pay out said tension line over the remote end of the boom, and including release means for attaching the lift mechanism at a series of different selectable positions along the length of the boom, allowing fast and convenient field adjustment of lift mechanism position to allow for objects that might otherwise interfere with desired positioning of the boom.

13. The portable hoist assembly of claim 12, wherein the release means comprises the boom having a series of holes along the boom's length, and the lifting mechanism having a bottom side with a saddle for engaging on the boom via two sides of the saddle and at least one pair of aligned holes in the two sides of the saddle to align with holes in the boom to receive a pin or other fastener to secure the position of the lifting mechanism on the boom.

14. The portable hoist assembly of claim 1, wherein said length of the boom is at least four feet.

15. A portable hoist assembly for lifting and moving heavy objects, including a boom pivotally connected to a frame or body that can be mounted on a stable larger object, and a support strut comprising a linear structural member having two ends, one end connected to the body at a position less than six inches below the pivotal connection of the boom, and the other end connected to the boom at a pivot connection remote from the body, to act as a support strut for the boom, the portable hoist assembly further comprising:

a lifting mechanism secured to an upper side of the boom, with a flexible tension line connected to the lifting mechanism to draw in or pay out tension line over a remote end of the boom, the portable hoist assembly having a total weight less than 45 pounds, and the boom having a length of at least three to four feet, and including release means for attaching the lift mechanism at a series of different selectable positions along the length of the boom, allowing for fast and convenient field adjustment of the position of the lifting mechanism to allow for objects that might otherwise interfere with desired positioning of the boom.

16. The improvement defined in claim 15, wherein the release means comprises the boom having a series of holes along a length of the boom, and the lift mechanism having a bottom side with a saddle for engaging on the boom via two sides of the saddle and at least one pair of aligned holes in the two sides of the saddle to align with holes in the boom to receive a pin or other fastener to secure the position of the lift mechanism on the boom.

17. The improvement defined in claim 15, wherein said position of connection of the support strut mechanism to the body is less than five inches below the boom's pivotal securement to the body.

18. The portable hoist assembly of claim 15, with a load lifting capacity of approximately 1000 pounds.

* * * * *